US008035468B2

(12) United States Patent
Hoffmann et al.

(10) Patent No.: US 8,035,468 B2
(45) Date of Patent: Oct. 11, 2011

(54) MAGNET SYSTEM EXTRUSION COATING FOR A RELAY

(75) Inventors: Ralf Hoffmann, Berlin (DE); Heinz Stadler, Munich (DE)

(73) Assignee: Tyco Electronics AMP GmbH, Benshiem (DE)

( * ) Notice: Subject to any disclaimer, the term of this patent is extended or adjusted under 35 U.S.C. 154(b) by 919 days.

(21) Appl. No.: 10/535,052

(22) PCT Filed: Nov. 6, 2003

(86) PCT No.: PCT/EP03/12364

§ 371 (c)(1),
(2), (4) Date: Dec. 27, 2005

(87) PCT Pub. No.: WO2004/047136

PCT Pub. Date: Jun. 3, 2004

(65) Prior Publication Data

US 2006/0139133 A1 Jun. 29, 2006

(30) Foreign Application Priority Data

Nov. 15, 2002 (EP) ..... 02025435

(51) Int. Cl.
*H01H 67/02* (2006.01)

(52) U.S. Cl. ..... 335/128; 335/78; 335/202

(58) Field of Classification Search ..... 335/78–86, 335/128–130, 202

See application file for complete search history.

(56) References Cited

U.S. PATENT DOCUMENTS

| | | | | |
|---|---|---|---|---|
| 4,185,163 | A * | 1/1980 | Schedele | 174/521 |
| 4,857,875 | A | 8/1989 | Matsuo et al. | 335/297 |
| 6,002,312 | A * | 12/1999 | Dittmann et al. | 335/78 |
| 6,252,479 | B1 * | 6/2001 | Kern et al. | 335/80 |
| 6,337,614 | B1 * | 1/2002 | Tsutsui | 335/160 |
| 6,590,480 | B2 * | 7/2003 | Matsuda | 335/78 |
| 7,135,946 | B2 * | 11/2006 | Hoffmann | 335/78 |

FOREIGN PATENT DOCUMENTS

| | | |
|---|---|---|
| DE | 31 42 890 A1 | 5/1983 |
| DE | 34 157 61 A1 | 10/1985 |
| DE | 44 36 404 A1 | 4/1996 |
| DE | 197 19 357 C1 | 10/1998 |
| JP | 2000-311568 | 11/2000 |
| WO | WO 99/22393 | 5/1999 |

OTHER PUBLICATIONS

International Search Report dated Apr. 28, 2004 for Application No. PCT/EP 03/12364.

* cited by examiner

*Primary Examiner* — Elvin G Enad
*Assistant Examiner* — Bernard Rojas
(74) *Attorney, Agent, or Firm* — Barley Snyder LLC

(57) ABSTRACT

A relay has a magnet system with a core partially enclosed by a coil. A yoke has a first yoke leg attached to a first end of the core and a second yoke leg extending parallel to the core. The second yoke leg has an armature mounting portion formed on an upper side of the second yoke leg remote from the coil. A pole has a first pole leg connected to a second end of the core and a second pole leg extending parallel to the core. The second pole leg has an upper surface substantially aligned with the armature mounting portion. A fixed contact is arranged on a fixed contact carrier substantially aligned with the second pole leg. The arrangement of the magnet system ensures precise positional alignment during extrusion coating with a plastic material.

17 Claims, 7 Drawing Sheets

MAGNET SYSTEM EXTRUSION COATING FOR A RELAY

BACKGROUND OF THE INVENTION

Field of the Invention

The invention relates to an electromagnetic relay and, more particularly, to an arrangement of a magnet system with an extrusion coating for an electromagnetic relay and a method for producing the same.

Summary of the Prior Art

DE 197 47 166 C1 discloses a relay with a magnet system and a method for producing the magnet system. The magnet system has a second yoke leg that extends laterally parallel to a coil axis and along the entire length of a core. The second yoke leg has a free yoke end that is substantially aligned with a pole flange. The free yoke end forms a bearing edge for a sheet-like armature. The armature has a spring contact mounted thereon. The armature and the spring contact are arranged parallel to an end face of the core or the coil. The spring contact has a switch contact corresponding to a fixed contact that is arranged on a fixed contact carrier on a coil flange of a core body.

In the above-described relay, and in other similar relays, it is important that the switch contact has enough force to contact the fixed contact even if contact erosion has occurred. The armature, therefore, is configured such that before the armature strikes the pole flange or pole face as the relay is picking up, the switch contact has already contacted the fixed contact. This is commonly referred to as overtravel. A relatively large overtravel is required to account for contact erosion that causes the contact force to decrease.

Various methods are known for adjusting the desired value of the overtravel, which, as previously described, is an important parameter in the service life of the relay. One such method is to adjust the spring contact by measuring and bending the spring contact. This method requires expensive apparatus, repeated adjustment, and is not error-free. DE 197 47 166 C1 also proposes that the yoke-core unit be pushed into the coil body in an axial direction until the magnet system is optimally positioned relative to the contacts. The magnet system in then fixed in this position by extrusion coating. This method, however, requires that there be insignificant tolerances and also requires repeated adjustment.

SUMMARY OF THE INVENTION

An object of the invention, therefore, is to provide a magnet system and a method for producing the magnet system for an electromagnetic relay wherein overtravel may be simply adjusted with relatively low production costs.

This and other objects are achieved by a magnet system with a core partially enclosed by a coil. A yoke has a first yoke leg attached to a first end of the core and a second yoke leg extending parallel to the core. The second yoke leg has an armature mounting portion formed on an upper side of the second yoke leg remote from the coil. A pole has a first pole leg connected to a second end of the core and a second pole leg extending parallel to the core. The second pole leg has an upper surface substantially aligned with the armature mounting portion such that when an armature is mounted on the armature mounting portion, a working air gap is formed between a coil-side armature face and the upper surface of the second pole leg.

This and other objects are further achieved by an electromagnetic relay comprising a magnet system having a core body with a core partially enclosed by a coil. A yoke has a first yoke leg attached to a first end of the core and a second yoke leg extending parallel to the core having an armature mounting portion. A pole has a first pole leg connected to a second end of the core and a second pole leg extending parallel to the core. A fixed contact is arranged on a fixed contact carrier substantially aligned with the second pole leg. The fixed contact carrier is offset in a direction of the core and arranged in the coil body. The magnet system is extrusion coated with a plastic material.

This and other objects are further achieved by a method for producing a magnet system for an electromagnetic relay. The method includes inserting a magnet system into an injection mold and allocating a face of an armature mounting portion, a pole leg, and a fixed contact carrier at complementary reference planes in the injection mold. The face of the armature mounting portion, the pole leg and the fixed contact carrier are pressed into the associated reference planes to achieve a desired size graduation between the faces.

BRIEF DESCRIPTION OF THE DRAWINGS

The invention will be described in more detail hereinafter with reference to the following figures, in which.

DETAILED DESCRIPTION OF THE PREFERRED EMBODIMENT

Figure 1:
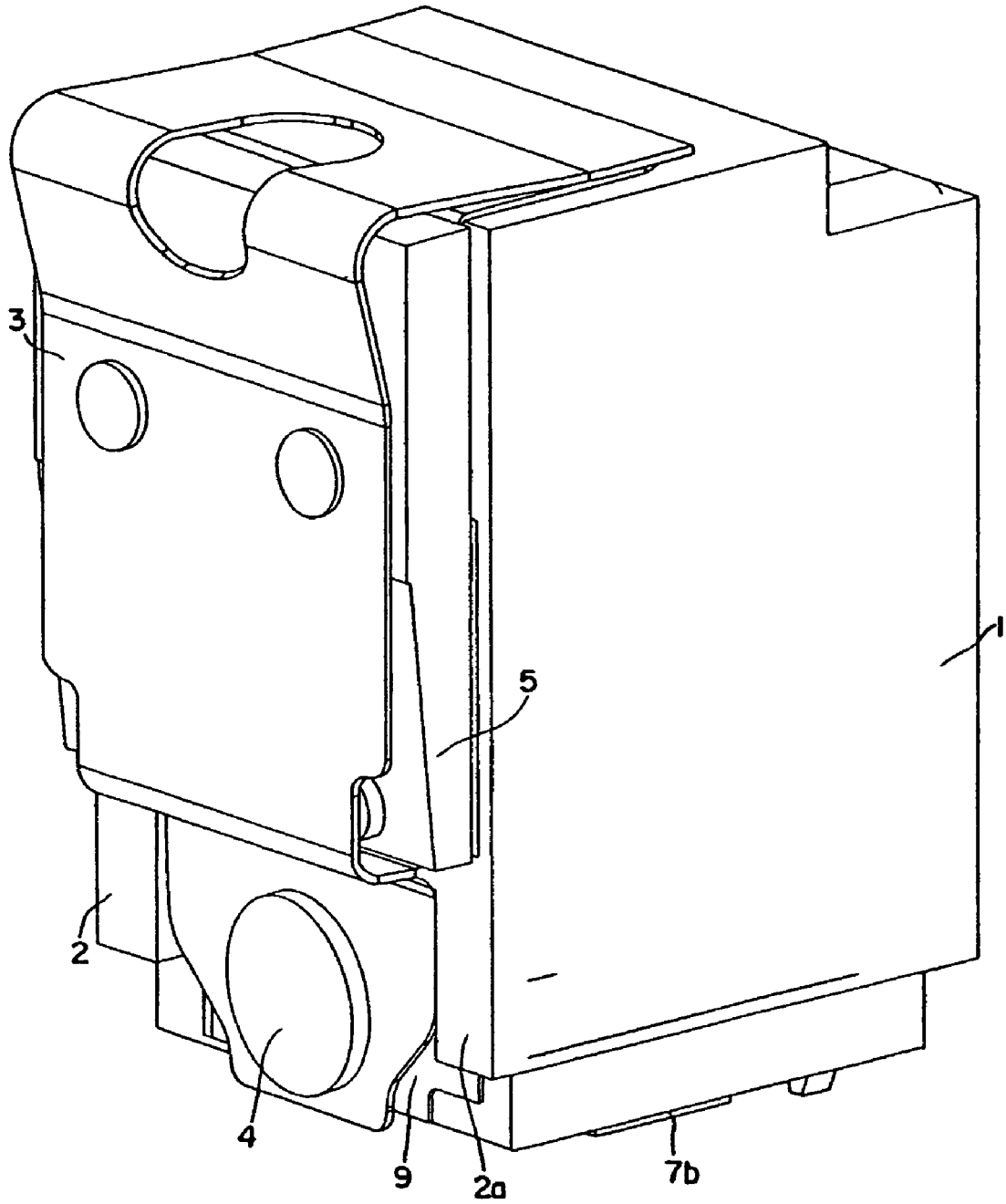
FIG. 1 is a perspective view of an extrusion coated magnet system for a relay according to the invention.

FIG. 1 shows an electromagnetic relay according to the invention having a magnet system embedded or surrounded in a plastic extrusion coating 1 and an armature-spring contact subassembly 3, 5. The magnet system of the relay will first be described in greater detail.

Figure 2:
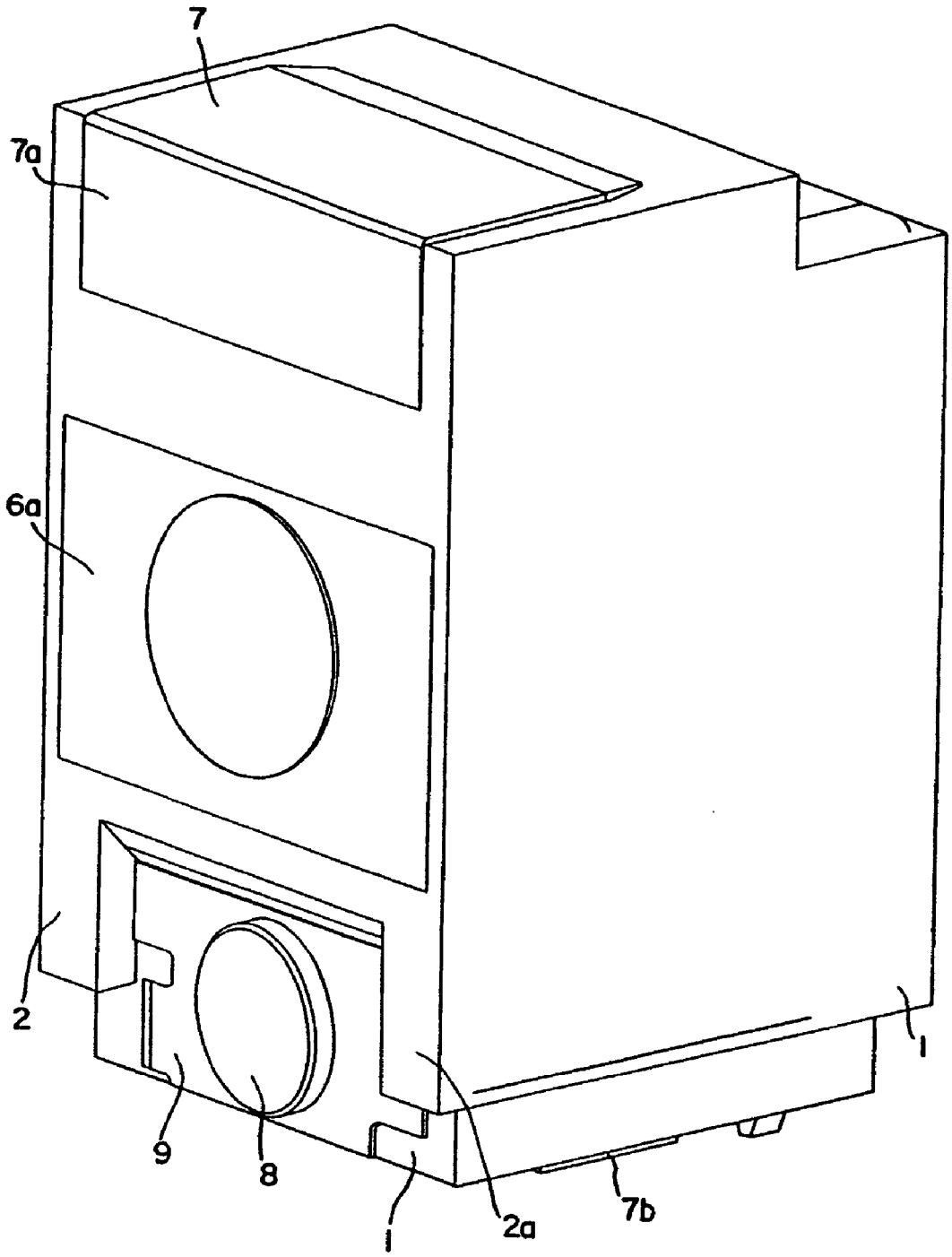
FIG. 2 is a perspective view of the magnet system of FIG. 1 without an armature or a spring contact.
Figure 3:
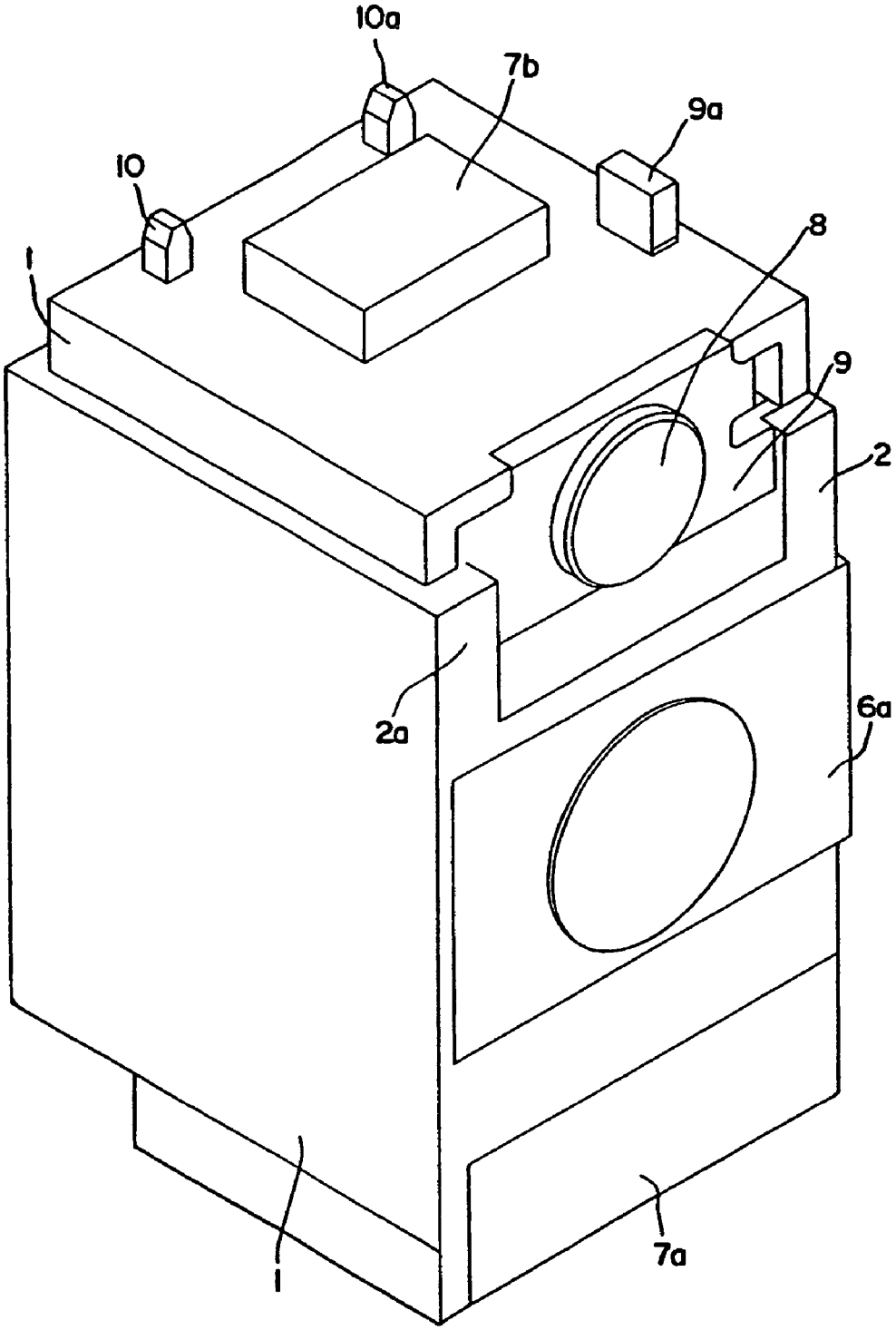
FIG. 3 is a perspective view of another side of the magnet system of FIG. 2.
Figure 4:
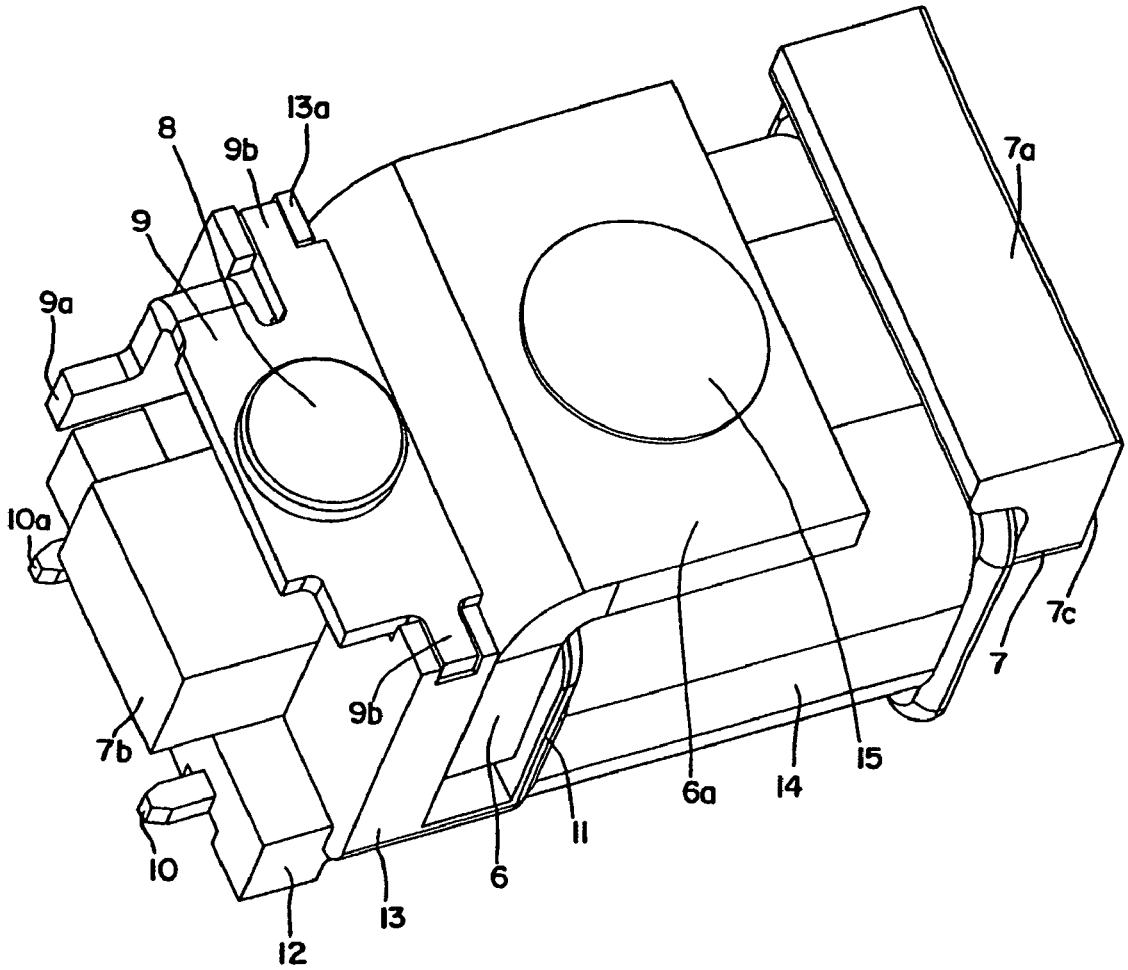
FIG. 4 is a perspective view of the magnet system before being extrusion coated.
Figure 5:
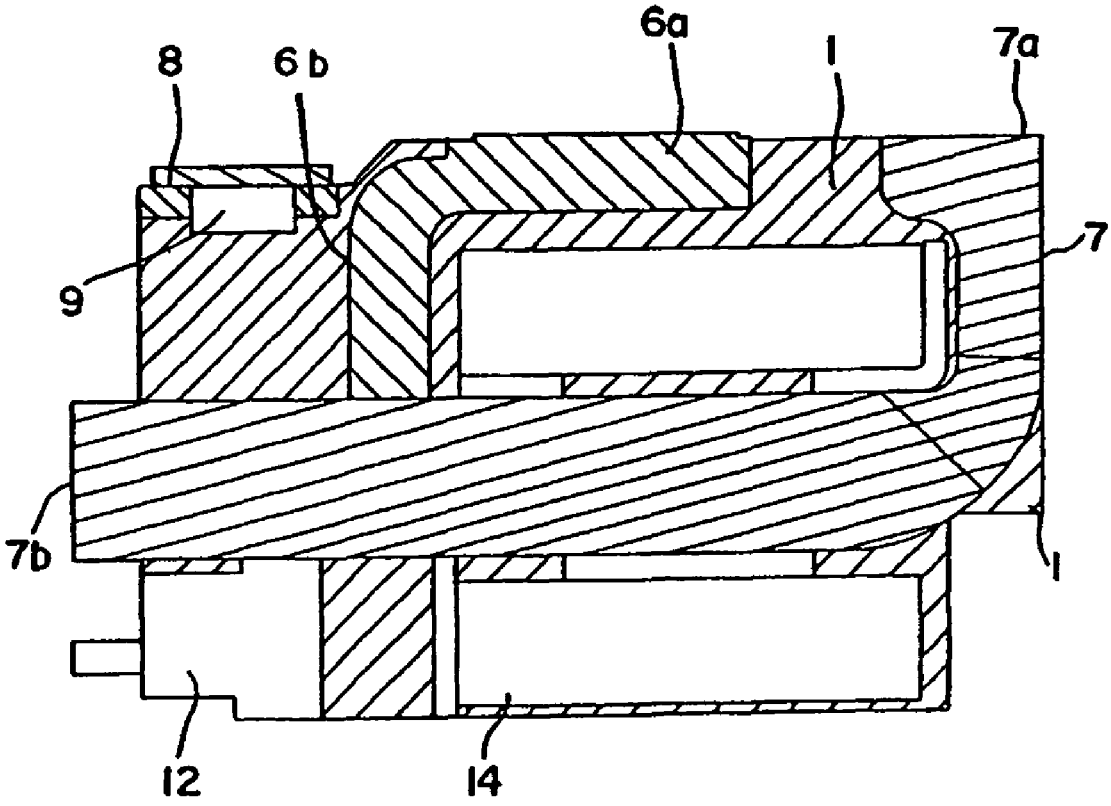
FIG. 5 is a cross-sectional view of the extrusion coated magnet system.

FIG. 1-3 and 5 show the magnet system embedded or surrounded in a plastic extrusion coating 1. FIG. 4 shows the magnet system before the magnet system is embedded or surrounded in the plastic extrusion coating 1. As shown in FIG. 4, the magnet system has a coil body 12 with a coil 14 and two coil terminals 10, 10*a*. A core 7*b* passes through the coil 14. As best shown in FIG. 5, an end of the core 7*b* projects relatively far out of the coil 14, and an opposing end of the core 7*b* is preferably integrally connected to a yoke 7. As shown in FIG. 4, the yoke 7 has a first yoke leg 7*c* connected to the core 7*b* and a second yoke leg with an armature mounting portion 7*a* formed parallel to the core 7*b*. The armature mounting portion 7*a* is formed at a front of the relay on the upper side of the second yoke leg and remote from the coil 14. As best shown in FIG. 5, the core-yoke unit 7, 7*a*, 7*b*, 7*c* is preferably somewhat flatter in a region of a bend from a coil space toward an end face of the coil 14, i.e., at the first yoke leg 7*c*, but has an increased width compared with the width of the coil space so an overall substantially uniform cross-section results. A length of the axially extending first yoke leg 7*c*, which does not extend over the entire length of the coil 14 as in conventional magnet systems, is crucial in fixing the adjustment problems between the magnet system and the corresponding contacts.

As shown in FIG. 4, a pole lamination is formed as an L-shaped pole 6. The pole 6 is held between a side arm 13 and a first flange 11 of the coil body 12. The pole 6 has a first pole leg 6*b* connected to the core 7*b* and a second pole leg 6*a* (pole flange) formed below the armature mounting portion 7*a* that extends parallel to the core 7*b*. The second pole leg 6*a* has a crowned pole face 15 at an upper side thereof. The pole leg 6 is connected to the core 7*b* by means of, for example, a U-shaped recess (not shown). The second pole leg 6*a* extends axially into the vicinity of the yoke 7. When the relay is fully assembled, a gap is formed between an edge of the armature mounting portion 7*a* of the yoke 7 and an opposing edge of the second pole leg 6*a* may then be bridged by an armature 5, described later, that is pivotally mounted on the armature mounting portion 7*a*. The armature 5 comes to rest on the upper side of the second pole leg 6*a* when the relay is picked up.

Below the second pole leg 6*a* and optionally offset therefrom, is a fixed contact carrier 9. Side portions 9*b* hold the fixed contact carrier 9 in pockets 13*a* of the side arm 13 of the coil body 12. The fixed contact carrier 9 is integrally connected to a terminal pin 9*a* via a terminal portion. The terminal pin 9*a* projects from a lower end face of the magnet system. The fixed contact carrier 9 further includes a fixed contact 8. The fixed contact 8 is arranged parallel to surfaces of the armature mounting portion 7*a* and the second pole leg 6*a*. The fixed contact 8, however, is arranged closer to the core in a lower plane to optimize installation space.

Figure 7:
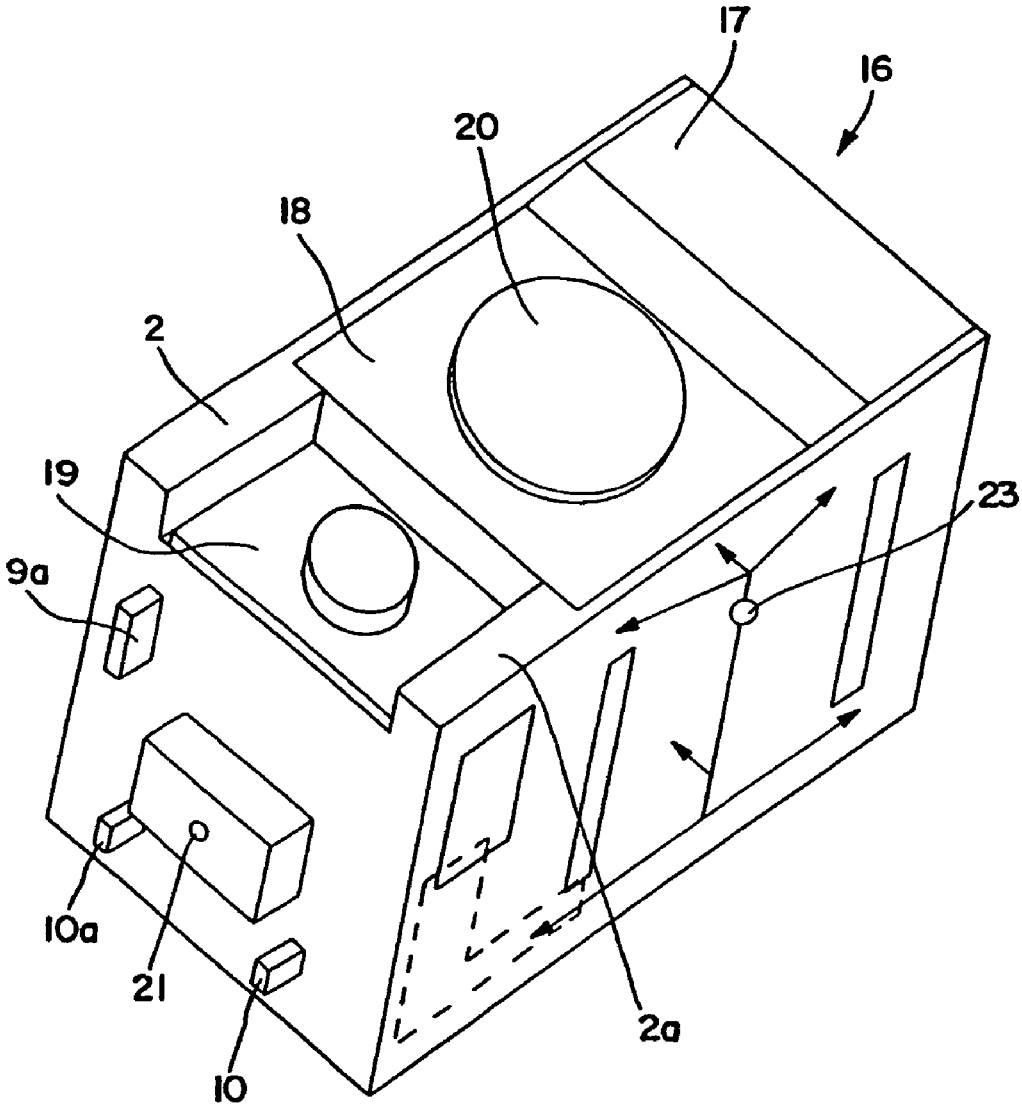
FIG. 7 is a perspective view of an injection mold for the extrusion coated magnet system.

The extrusion coating of the magnet system will now be described in greater detail. To encase the magnet system with a plastic material, the core-yoke unit 7, 7*a*, 7*b*, 7*c* the pole 6, the fixed contact carrier 9, and the fixed contact 8 are placed in an interior of the core body 12 to form a subassembly. The subassembly is inserted, for example, by grippers, into an injection mold 16, as shown in FIG. 7.

The injection mold 16 includes openings 20, 21 for the crowned pole face 15 and for the core 7*b*, respectively. The injection mold 16 has reference planes 17, 18, 19. A tunneling gate may be formed at 23 or on both sides of the injection mold 16 at this location. The size graduation between the faces formed by the upper sides of the armature mounting portion 7*a*, the second pole leg 6*a* and the fixed contact carrier 9, is achieved by injection mold-determined reference planes for accurate fixing in position. The size graduation is advantageously achieved by allocating these three faces (upper sides of 7*a*, 6*a* and 9) to complementary reference planes in the injection mold 16 and by pressing, these three faces to be extrusion coated onto the associated reference planes 17, 18, 19 in the injection mold 16. When encasing the coil body 12 and the fixed contact carrier 9, it is advantageous if axially extending webs 2, 2*a* are injected above regions of the side portions 9*b*, as best shown in FIG. 1. FIGS. 2-3 show the magnet system after it has been embedded in the extrusion coating 1, but before attachment of the armature-spring contact assembly 3, 5.

Figure 6:
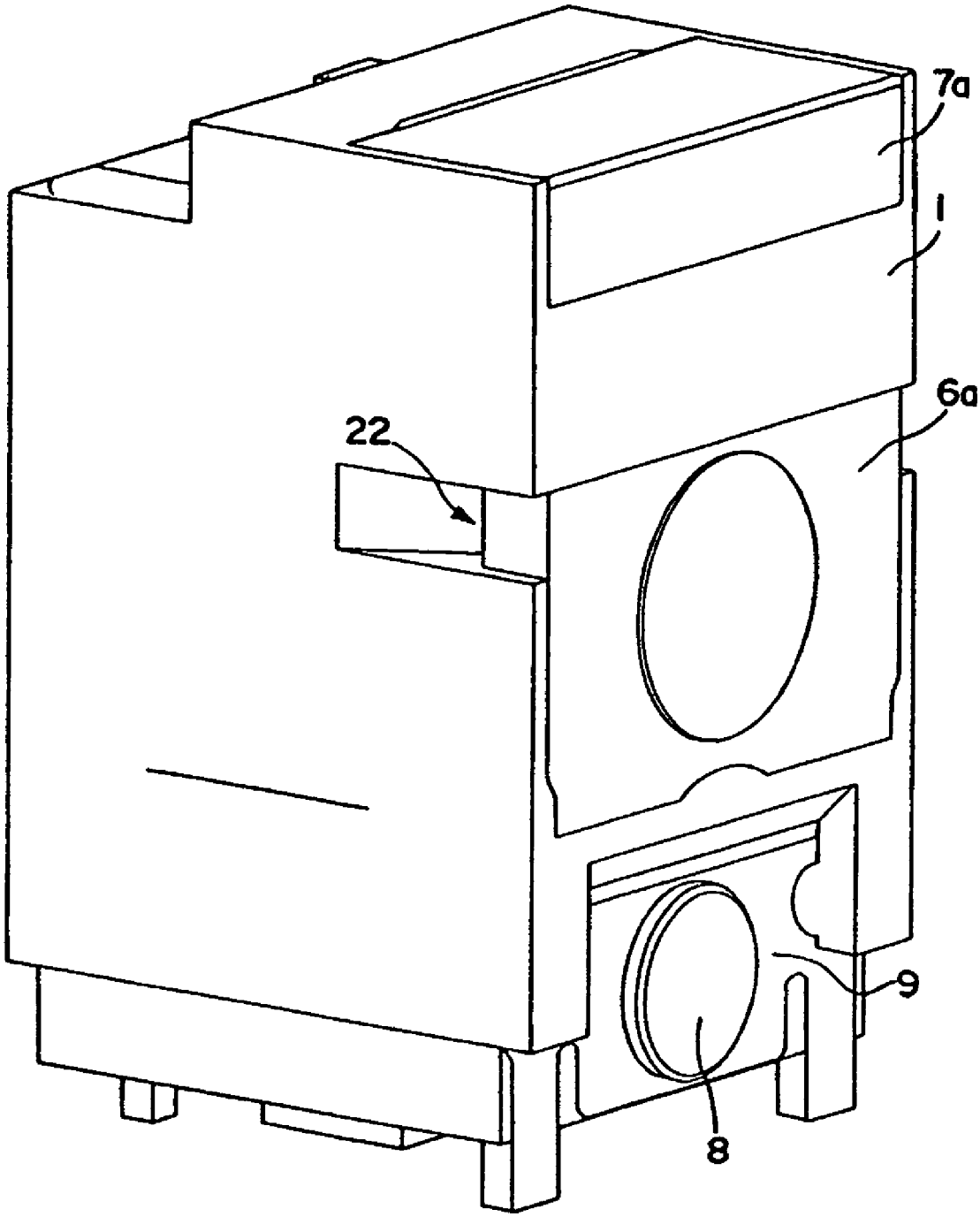
FIG. 6 is an alternate embodiment of the extrusion coated magnet system.

FIG. 6 shows an alternate embodiment of the extrusion coated magnet system. As shown in FIG. 6, an additional pressure point 22 may be created with the injection mold 16, wherein the second pole leg 6*a* may be pressed against an associated reference plane 18 of the injection mold 16.

As shown in FIG. 1, after the magnet system has been embedded in the extrusion coating 1, a sheet-like armature 5 is mounted on the armature mounting portion 7*a* such that a working air gap is formed between a coil-side armature face and the second pole leg 6*a*. A spring contact 3 is fastened to an unwound portion at an upper end face of the magnet system. A bent portion of the spring contact 3 surrounds the armature mounting portion 7*a* to form a bearing. The spring contact 3 has a central portion rigidly connected to the armature 5 and is mounted such that the armature 5 may move the spring contact 3. The spring contact 3 and the armature thereby form a subassembly. A free end of the spring contact 3 is movably received between the webs 2, 2*a*. The free end of the spring contact 3 is provided with a switch contact 4 that opposes the fixed contact 8.

Owing to the configuration of the armature mounting portion 7*a* and the second pole leg 6*a*, which are arranged virtually aligned with one another on a longitudinal side of the coil 14, the magnet system and the contact system may be arranged in precise positional alignment. In addition, because the fixed contact carrier 9 is arranged in the coil body 12 substantially parallel to the upper side of the second pole leg 6*a* and preferably offset in a direction of the core 7*b*, and the magnet system, the basic body 12, and the fixed contact carrier 9 are substantially completely extrusion coated 1, the armature 5 attains an end position on the pole 6. The remaining tolerance to the fixed contact 8, therefore, may be reduced by the method of assembly to a very accurate, injection mold-determined size. In this manner the desired fit between the magnet system and the contact carrier and the desired overtravel is adjusted without additional measures owing to the forced fit of the magnet system in the injection mold 16. Because any tolerance-induced deviations from the desired fit are overcome by the relative positioning that results from the pressure that builds up in the injection mold 16 and by the additional pressing that occurs in the injection mold 16, the components of the magnet system are displaced and fixed in the correct position. The invention described herein may also be used in a duo relay.

We claim:

1. A magnet system for a relay comprising:

a coil body with a coil, a flange, and a side arm;

a core partially enclosed by the coil;

a yoke having a first yoke leg attached to a first end of the core and a second yoke leg extending parallel to the core, the second yoke leg having an armature mounting portion formed on an upper side of the second yoke leg remote from the coil;

a pole having a first pole leg connected to a second end of the core and a second pole leg extending parallel to the core, the second pole leg having an upper surface substantially aligned with the armature mounting portion such that when an armature is mounted on the armature mounting portion, a working air gap is formed between a coil-side armature face and the upper surface of the second pole leg, the pole is positioned between the side arm and the first flange;

a fixed contact carrier with a fixed contact, the fixed contact carrier having side portions that extend from the fixed contact carrier and hold the fixed contact carrier in pockets of the side arm of the coil body such that the fixed contact is arranged parallel to surfaces of the armature mounting portion and the second pole leg; and the magnet system is extrusion coated with a plastic material, the coil, the yoke, the pole, and the fixed contact carrier being embedded in the plastic material.

2. The magnet system according to claim 1, wherein the upper surface of the second pole leg includes a crowned pole face.

3. The magnet system according to claim 1, wherein the yoke is L-shaped.

4. The magnet system according to claim 1, wherein the pole is L-shaped.

5. The magnet system according to claim 1, wherein the first pole leg is connected to the core by a U-shaped recess.

6. The magnet system according to claim 1, wherein an edge of the armature mounting portion and an edge of the second pole leg are positioned such that a gap is formed therebetween that is bridged by the armature.

7. The magnet system according to claim 1, wherein the fixed contact arranged on the fixed contact carrier is substantially aligned with the second pole leg.

8. The magnet system according to claim 7, wherein the fixed contact carrier is offset in a direction of the core.

9. The magnet system according to claim 1, wherein the magnet system is mounted on a coil body.

10. An electromagnetic relay comprising:

a magnet system having a coil body a side arm, a flange and a coil, and a core body with a core partially enclosed by the coil;

a yoke having a first yoke leg attached to a first end of the core and a second yoke leg extending parallel to the core having an armature mounting portion;

a pole having a first pole leg connected to a second end of the core and a second pole leg extending parallel to the core, the pole is positioned between the side arm and the flange;

the magnet system having a fixed contact arranged on a fixed contact carrier substantially aligned with the second pole leg, the fixed contact carrier being offset in a direction of the core and arranged in the coil body, the fixed contact carrier having side portions that extend from the fixed contact carrier and hold the fixed contact carrier in pockets of the side arm of the coil body such that the fixed contact is arranged parallel to surfaces of the armature mounting portion and the second pole leg; and the magnet system is extrusion coated with a plastic material, the coil, the yoke, the pole, and the fixed contact carrier being embedded in the plastic material.

11. The electromagnetic relay according to claim 10, wherein a sheet-like armature is pivotally mounted on the armature mounting portion, the armature having a spring contact with a switching contact positioned adjacent to the fixed contact.

12. The electromagnetic relay according to claim 11, wherein a free end of the spring contact is movably received between injection molded webs.

13. The electromagnetic relay according to claim 10, wherein the second pole leg has an upper surface substantially aligned with the armature mounting portion.

14. The electromagnetic relay according to claim 13, wherein an edge of the armature mounting portion and an edge of the second pole leg are positioned such that a gap is formed therebetween that is bridged by the armature.

15. The electromagnetic relay according to claim 11, wherein the spring contact is bent such that the switching contact engages the fixed contact before the armature engages an upper surface of the second pole leg.

16. A method for producing a magnet system for an electromagnetic relay, comprising the steps of:

inserting a magnet system into an injection mold;

allocating a face of an armature mounting portion, a pole leg and a fixed contact carrier, having side portions that extend from the fixed contact carrier and hold the fixed contact carrier in pockets of a side arm of a coil body with a flange such that a fixed contact positioned on the fixed contact carrier is arranged parallel to surfaces of the armature mounting portion and the pole leg that is positioned between the side arm and the flange, at complementary reference planes in the injection mold; and pressing the face of the armature mounting portion, the pole leg and the fixed contact carrier into the associated reference planes to achieve a desired size graduation between the faces.

17. The method of claim 16, further comprising the step of injection molding webs on opposing sides of the fixed contact carrier.

* * * * *